United States Patent [19]

Savage

[11] Patent Number: 4,614,220

[45] Date of Patent: Sep. 30, 1986

[54] METHOD FOR CONTINUOUSLY CASTING THIN SHEET

[75] Inventor: Steven J. Savage, Yellow Aprings, Ohio

[73] Assignee: The United States of America as represented by the Secretary of the Air Force, Washington, D.C.

[21] Appl. No.: 672,237

[22] Filed: Nov. 16, 1984

[51] Int. Cl.[4] ..... B22D 11/00

[52] U.S. Cl. ..... 164/461; 164/463; 164/479; 164/485; 164/488; 164/900; 264/167; 264/171; 156/244.11; 156/244.27

[58] Field of Search ..... 164/488, 479, 480, 133, 164/427, 429, 428, 463, 423, 461, 476, 485, 900; 222/591, 592, 606, 607; 264/167, 171; 425/374, 376 B; 156/244.11, 244.27

[56] References Cited

U.S. PATENT DOCUMENTS

| | | | |
|---|---|---|---|
| 510,808 | 12/1893 | Lloyd | 164/429 X |
| 2,693,012 | 11/1954 | Harris et al. | 164/480 |
| 2,757,426 | 8/1956 | Brennan | 164/479 X |
| 2,838,814 | 6/1958 | Brennan | 164/461 |
| 2,912,321 | 11/1959 | Brennan | 164/122 |
| 2,931,082 | 4/1960 | Brennan | 164/461 |
| 3,338,295 | 8/1967 | Scribner | 164/479 |
| 3,381,739 | 5/1968 | Hart | 164/488 X |
| 3,670,400 | 6/1972 | Singer | 164/479 X |
| 3,708,565 | 1/1973 | Seiffert | 264/171 |
| 3,856,074 | 12/1974 | Kavesh | 164/463 |
| 4,111,631 | 9/1978 | Gabrielli | 425/376 A |
| 4,224,978 | 9/1980 | Klein | 164/461 |
| 4,285,386 | 8/1981 | Narasimhan | 164/429 X |
| 4,301,854 | 11/1981 | Bedell et al. | 164/479 |
| 4,329,309 | 5/1982 | Kelly | 264/167 |

FOREIGN PATENT DOCUMENTS

| | | | |
|---|---|---|---|
| 57-32853 | 2/1982 | Japan | 164/463 |
| 57-79053 | 5/1982 | Japan | 164/463 |

*Primary Examiner*—Nicholas P. Godici
*Assistant Examiner*—Richard K. Seidel
*Attorney, Agent, or Firm*—Charles E. Bricker; Donald J. Singer

[57] ABSTRACT

A process and apparatus for continuously casting a castable material to a thickness of 10 to 40 mils. A molten material is first spread onto a spreading roller to a uniform thickness and then transferred to a quenching roller whereon the material is cooled until dimensionally stable. The apparatus may be employed to continuously cast thin sheet, platelets, wire, etc. The materials castable by this process and apparatus include metals, alloys, glasses, thermoplastic materials and metalloids.

7 Claims, 4 Drawing Figures

METHOD FOR CONTINUOUSLY CASTING THIN SHEET

RIGHTS OF THE GOVERNMENT

The invention described herein may be manufactured and used by or for the Government of the United States for all governmental purposes without the payment of any royalty.

BACKGROUND OF THE INVENTION

This invention relates to a process for continuously casting metal or metalloids.

The casting of metal into coninuous sheet form by means of a rotating roller integral with the feed housing is known in the art. Brennan, U.S. Pat. No. 2,912,321, describes a sheet casting apparatus including a crucible, a rotatably supported wheel, a die cavity, and a vertical passage in communication with the die cavity and the crucible. The metal melt in the crucible is passed through the vertical passage into the die cavity and onto the wheel. The wheel is cooled, thus cooling the metal in contact with it.

Brennan, U.S. Pat. Nos. 2,838,814 and 2,931,082, describes apparatus in which the molten metal is cast onto a rotating ring wherein the ring and the cast metal pass through cooling dies for solidification of the metal.

In recent years, considerable research has been devoted to the microstructure of metals and alloys. It is known, for example, that certain post-forming heat treatments can provide improved tensile and stress crack resistance. It is desirable, however, to provide better control of the microstructures during the forming process.

Accordingly, it is an object of the present invention to provide an improved process for the continuous production of sheet material.

Other objects and advantages of the present invention will be apparent to those skilled in the art.

SUMMARY OF THE INVENTION

In accordance with the present invention there is provided a process for continuously casting a thin sheet of castable material, such as metal, which comprises feeding molten material through a metering cap and onto a rotating spreading roller, passing the thus-spread metal into and through the nip between said spreading roller and a quenching roller, taking the thus-formed sheet off the spreading roller and onto the quenching roller, maintaining the sheet in contact with the quenching roller until it is dimensionally stable, and thereafter removing the sheet from the quenching roller.

One feature of the present invention is the spreading roller integral with the molten material feed system which assures that the molten material is continuously and evenly spread to its desired sheet thickness prior to cooling.

DESCRIPTION OF THE INVENTION

Figure 1:
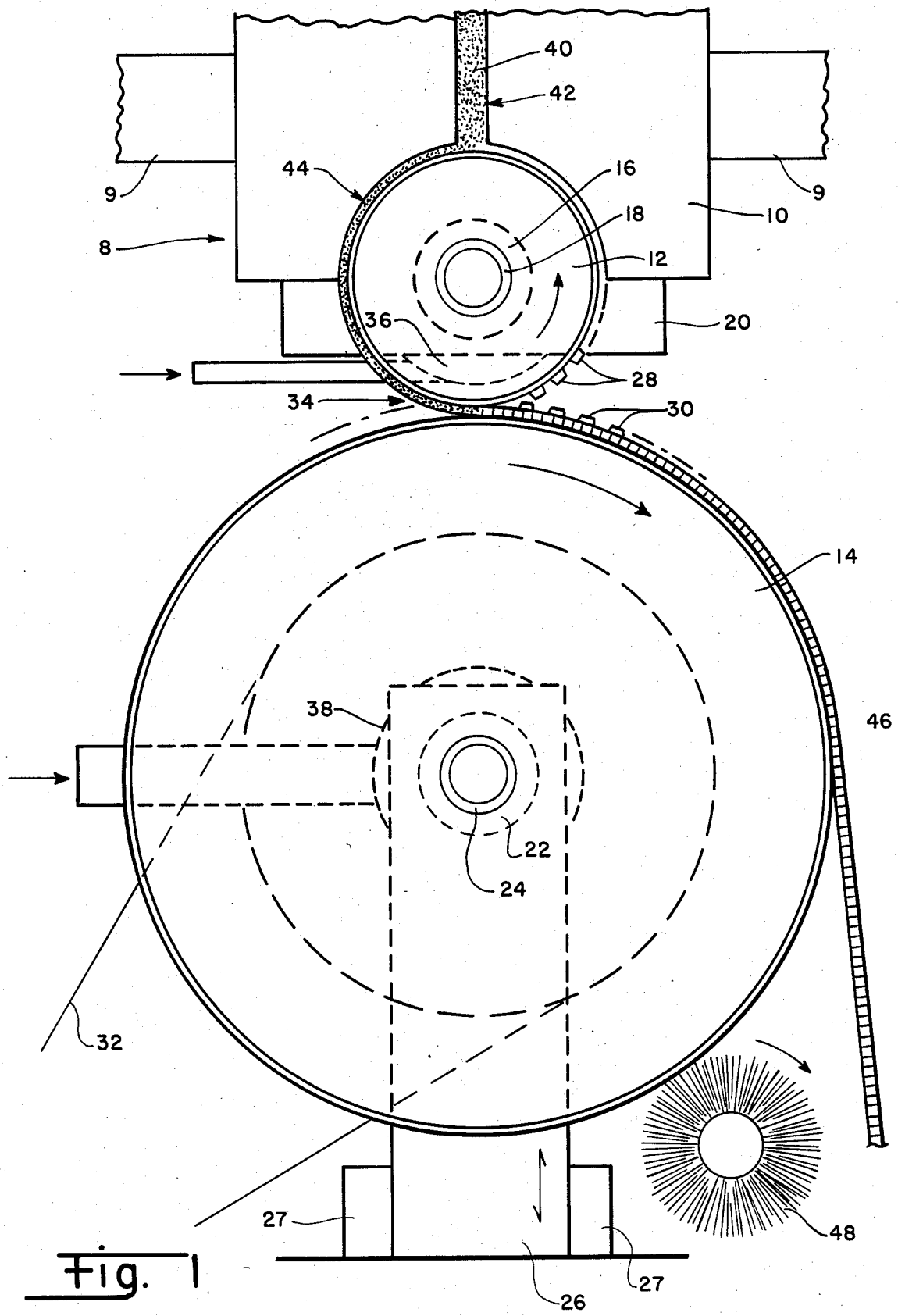
FIG. 1 is a side elevation view of one form of apparatus constituting the present invention.

Referring to the drawings, FIG. 1 is illustrative of an apparatus suitable for carrying out the purpose of this invention wherein the numeral 8 represents a spreading and thicknessing die comprising a fixed part, or roller housing 10 and a spreading roller 12, and 14 represents a quenching roller. The lower portion of housing 10 is curved to fit closely adjacent to roller 12 which is rotatably supported adjacent the lower side of housing 10 by suitable bearings 16, shaft 18 and shaft support member 20. Roller 14 is similarly rotatably supported in parallel relation to roller 12 by bearings 22, shaft 24 and shaft support member 26. The shaft support member 26 comprises adjustment means 27 for varying the nip 34 between rollers 12 and 14. Frame means 9 are provided for supporting the die 8.

The relative speeds of rotation of rollers 12 and 14 are maintained by suitable means such as, for example, gears in driving relation to rollers 12 and 14 a representative few of the gear teeth of each being shown at 28 and 30, respectively.

Either roller 12 or roller 14 is rotatably driven by a motor means, not shown, via direct, belt, chain, or other suitable drive means, such as the exemplary chain drive means indicated by reference numeral 32. The rotary motion imparted to either of these rollers is in turn imparted to the other roller through the gears 28 and 30. In a presently preferred embodiment, the circumferential speed of roller 12 is the same as that of roller 14. Thus, the gears 28 and 30 have identical pitch and the pitch circle of each gear is selected to have a diameter approximately equal to that of its associated roller.

The shafts 18 and 24 comprise integral fluid passageways so that fluids may be introduced into and withdrawn from the rollers 12 and 14, respectively, through rotary union means 36 and 38, respectively. The roller 14 is cooled to provide a cooling rate at the nip 34 of at least about 100° K./sec by passing a cooled fluid such as water, oil or a suitable gas through roller 14. The roller 12 may be cooled or heated, depending upon the requirements of the material being processed, in like fashion.

In operation, a molten material 40 to be cast is introduced through delivery passage 42 in block 10 and into the spreading passage 44 formed by the concave portion of housing 10 and the convex surface of roller 12. The rotating roller 12 picks up a finite layer of the material and carries this layer around to the nip 34 where the material contacts the cooled roller 14. The material is, in essence, picked off roller 12 at the nip 34 and thereafter maintained in contact with the roller 14 for less than one complete revolution of roller 14, until it is dimensionally stable, i.e., solidified. The solidified material 46 is taken off roller 14 and coiled or otherwise processed.

As indicated previously, the lower portion of housing 10 is curved to fit closely adjacent to the roller 12. The housing 10 and the roller 12 are preferably manufactured as a unit such that the working clearances, together with other operating parameters such as temperature, density and viscosity of the molten material 40, as well as atmosphere and the circumferential speed, of roller 12, form a metering device, by which the flow rate of the material 40 may be controlled. In general, the clearance between the roller 12 and housing 10 in the region of the spreading passage 44 can be in the approximate range of 10 to 40 mils, preferably about 10 to 20 mils.

The process and apparatus of the present invention may be employed to cast a variety of materials including metals, alloys, metalloids, glasses, thermoplastic resins, and the like, including suspensions of solid particles. Exemplary metals include titanium, copper, aluminum, iron and the like. Exemplary alloys include iron-silicon, aluminum alloys, titanium alloys, stainless steel and the like. Suitable glasses include metallic glasses, oxide glasses, silicate glasses and the like. Suitable thermoplastic resins include polyethylene, polypropylene, polyvinyl chloride, and the like. Exemplary suspensions of solid particles include silicon carbide particles suspended in molten aluminum, aluminum oxide particles suspended in aluminum, rare earth metal oxides suspended in titanium, and the like.

Figure 2:
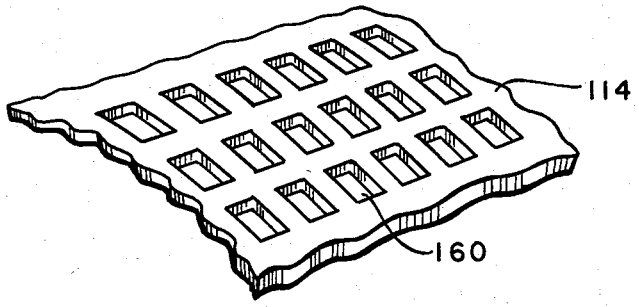
FIGS. 2 and 3 are portions of rollers for forming platelets and continuous wire-like strip, respectively.

The process and apparatus of this invention may be employed to cast a variety of shapes including discontinuous strip, platelet, and fiber, as well as the continuous sheet discussed heretofore. Either or both of the spreading roller 12 and the quenching roller 14 may have markings etched, engraved or otherwise applied to the surface thereof, which allow the shape, thickness or other properties of the product to be varied in a desired manner. For example, FIG. 2 illustrates a portion of a quench roller 114 having a plurality of square depressions 160 machined therein. When such machined roller 114 is employed, a rotary brush 48 is employed, as shown in FIG. 1, to assure complete removal of platelets formed in the depressions 160 from the roller.

Figure 3:
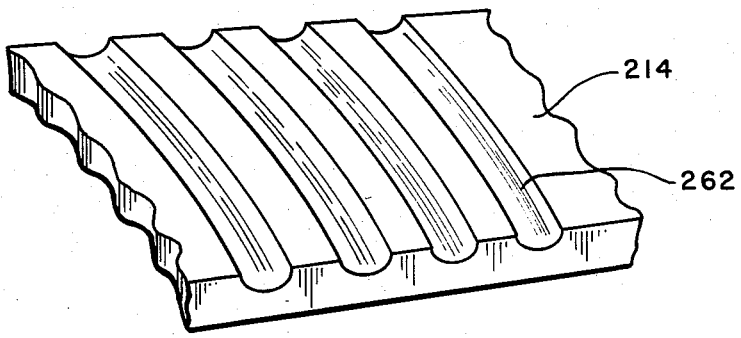

FIG. 3 illustrates a portion of a quench roller 214 having a plurality of circumferential grooves 262 machined therein, for forming continuous rounded strips.

The apparatus shown in FIG. 1 may be used in the position illustrated, employing gravity feed or pressure feed to supply the molten material 40 to the apparatus. The apparatus may also be used in an inverted position, or rotated 90 degrees in either direction, employing pressure feed to supply the material 40.

Figure 4:
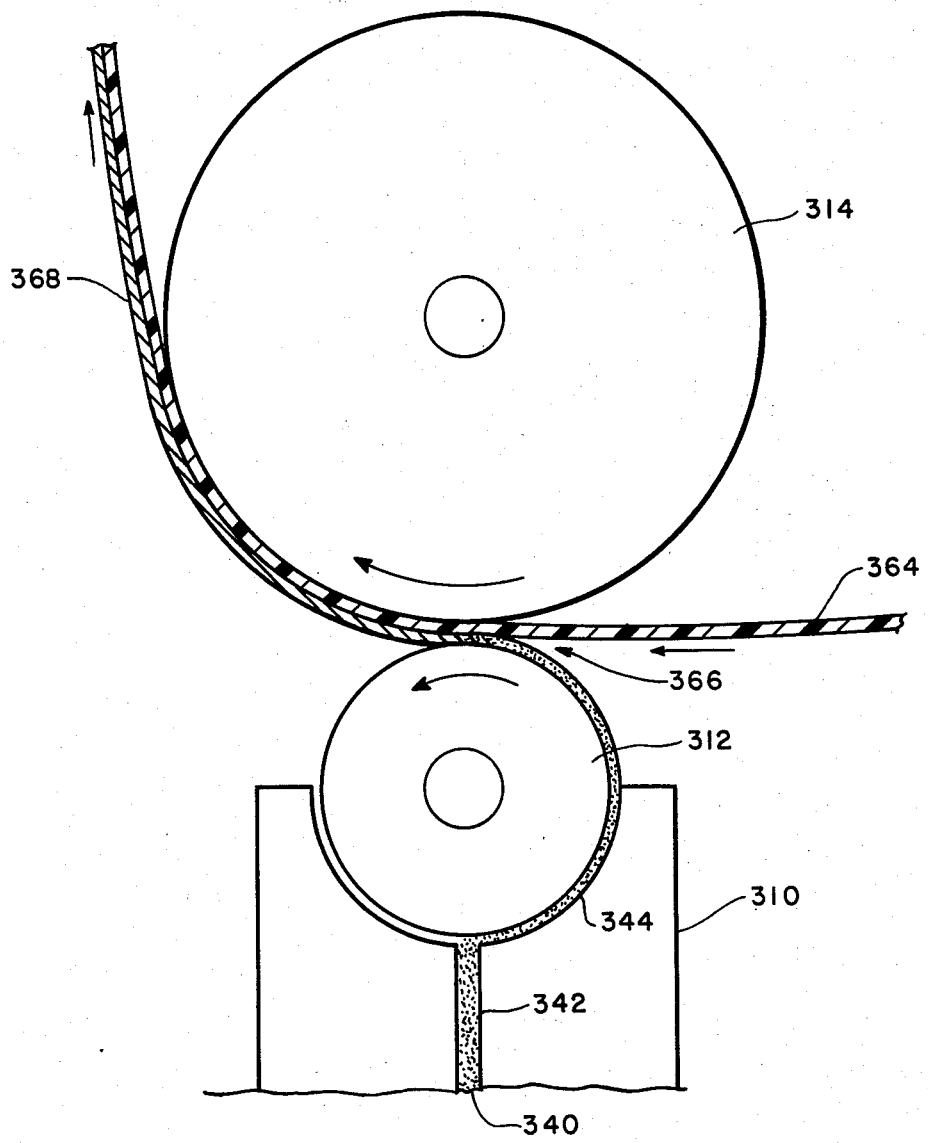
FIG. 4 is a side elevation of another form of the apparatus of the invention illustrating the fabrication of a multi-layer product.

The apparatus of this invention may be employed to fabricate multi-layer materials. Referring to FIG. 4, which illustrates an apparatus according to the invention in the inverted position, comprising a roller housing 310, a spreading roller 312, and a quenching roller 314. The housing 310 has a delivery passage 342 and a spreading passage 344 for introducing a material 340 to be cast. A previously prepared strip 364 is supplied from a roll, not illustrated, and passed into the nip 366 between the rollers 312 and 314. The material 340 is introduced through passages 342 and 344 and carried by the roller 312 to the nip 366 where it is deposited onto the strip 364 and simultaneously cooled. The resulting strip 368 is a two-layer strip. As an example, the strip 364 may be a polyimide film and the material 340 may be molten copper. The resulting strip 368 is useful in the manufacture of flexible printed circuits. In general, the strip 364 may be any sheet material including those materials described previously, as well as thermosetting plastic materials.

The apparatus of this invention may be fabricated from any suitable materials. The quench roller 14, for example, may be made of an alloy of copper and beryllium. The roller housing 10 may be made of a metal, metal alloy or a ceramic material.

The process and apparatus of this invention make relatively thin sheet, platelet, strip or other form, i.e., finished material with a thickness in the approximate range of 10 to 40 mils. The imposed cooling rate of at least 100° K./sec in the quenching roller 14 can give rise to novel microstructures and properties. It may be desirable to also control the temperature of the spreading roller 12.

Various modifications may be made without departing from the spirit of the invention or the scope of the appended claims.

I claim:

1. A process for continuously casting a thin layer of a suspension of solid particles in solid metal which comprises feeding said suspension in the molten state into the spreading passage of a spreading and thicknessing die comprising a roller housing and a spreading roller, said housing having a curved portion adapted to fit adjacent to and spaced apart from said roller, said spreading passage being defined by said curved portion and said roller, to provide on said spreading roller a layer of molten material having a thickness in the approximate range of 10 to 40 mils, passing the thus-spread material into and through the nip between said spreading roller and a quenching roller, taking the thus-formed layer off said spreading roller and onto the said quenching roller, maintaining said layer in contact with said quenching roller until dimensionally stable, and removing the resulting stable layer from said quenching roller, wherein said quenching roller is cooled to provide a cooling rate of at least about 100° K./min.

2. A process for continuously casting a thin layer of metal which comprises feeding said metal in the molten state into the spreading passage of a spreading and thicknessing die comprising a roller housing and a spreading roller, said housing having a curved portion adapted to fit adjacent to and spaced apart from said roller, said spreading passage being defined by said curved portion and said roller, to provide on said spreading roller a layer of molten material having a desired thickness in the approximate range of 10 to 40 mils, passing the thus-spread material into and through the nip between said spreading roller and a quenching roller, taking the thus-formed layer off said spreading roller and onto the said quenching roller, maintaining said layer in contact with said quenching roller until dimensionally stable, and removing the resulting stable layer from said quenching roller, wherein said quenching roller is cooled to provide a cooling rate of at least about 100° K./min.

3. The method of claim 2 wherein said metal is titanium.

4. A process for continuously casting a thin layer of a metal alloy which comprises feeding said alloy in the molten state into the spreading passage of a spreading and thicknessing die comprising a roller housing and a spreading roller, said housing having a curved portion adapted to fit adjacent to and spaced apart from said roller, said spreading passage being defined by said curved portion and said roller, to provide on said spreading roller a layer of molten material having a thickness in the approximate range of 10 to 40 mils, passing the thus-spread material into and through the nip between said spreading roller and a quenching roller, taking the thus-formed layer off said spreading roller and onto the said quenching roller, maintaining said layer in contact with said quenching roller until dimensionally stable, and removing the resulting stable layer from said quenching roller, wherein said quenching roller is cooled to provide a cooling rate of at least about 100°K./min.

5. The method of claim 4 wherein said alloy is a titanium alloy.

6. A process for continuously casting a thin layer of a metalloid which comprises feeding said metalloid in the molten state into the spreading passage of a spreading and thicknessing die comprising a roller housing and a spreading roller, said housing having a curved portion adapted to fit adjacent to and spaced apart from said roller, said spreading passage being defined by said curved portion and said roller, to provide on said spreading roller a layer of molten material having a thickness in the approximate range of 10 to 40 mils, passing the thus-spread material into and through the nip between said spreading roller and a quenching roller, taking the thus-formed layer off said spreading roller and onto the said quenching roller, maintaining said layer in contact with said quenching roller until dimensionally stable, and removing the resulting stable layer from said quenching roller, wherein said quenching roller is cooled to provide a cooling rate of at least about 100° K./min.

7. A process for fabricating a multi-layer sheet which comprises feeding copper in the molten state into the spreading passage of a spreading and thicknessing die comprising a roller housing and a spreading roller, said housing having a curved portion adapted to fit adjacent to and spaced apart from said roller, said spreading passage being defined by said curved portion and said roller, to provide on said spreading roller a layer of molten copper having a thickness in the approximate range of 10 to 40 mils, feeding a formed sheet of a polyimide into the nip between said spreading roller and a quenching roller, passing the thus-spread copper on said spreading roller into and through said nip, whereby said layer of copper is deposited onto said sheet of polyimide, maintaining said sheet of polyimide with said layer of copper thereon in contact with said quenching roller until said copper is dimensionally stable, and thereafter removing the resulting multi-layer sheet from said quenching roller, wherein said quenching roller is cooled to provide a cooling rate of at least about 100° K./min.

* * * * *